US007086118B2

(12) United States Patent
Engel et al.

(10) Patent No.: US 7,086,118 B2
(45) Date of Patent: Aug. 8, 2006

(54) STREET SWEEPER WITH VACUUMIZED DUST CONTROL

(75) Inventors: Gregory J. Engel, Plymouth, MN (US); Steven L. Boomgaarden, Rosemont, MN (US)

(73) Assignee: Tennant Company, Minneapolis, MN (US)

( * ) Notice: Subject to any disclaimer, the term of this patent is extended or adjusted under 35 U.S.C. 154(b) by 127 days.

(21) Appl. No.: 10/236,094

(22) Filed: Sep. 6, 2002

(65) Prior Publication Data

US 2004/0045111 A1 Mar. 11, 2004

(51) Int. Cl.
*A47L 9/10* (2006.01)

(52) U.S. Cl. ..... 15/340.4; 15/348; 15/349; 15/352

(58) Field of Classification Search ..... 15/340.4, 15/347, 348, 349, 352
See application file for complete search history.

(56) References Cited

U.S. PATENT DOCUMENTS

| | | | | | |
|---|---|---|---|---|---|
| 1,610,119 | A | * | 12/1926 | Butler | 15/348 |
| 3,008,542 | A | | 10/1959 | Steele | |
| 3,186,021 | A | * | 6/1965 | Krier et al. | 15/340.4 |
| 3,604,051 | A | | 9/1971 | Wendel et al. | 15/352 |
| 3,639,940 | A | | 2/1972 | Carlson et al. | 15/352 |
| 3,756,416 | A | | 9/1973 | Wood | |
| 3,792,569 | A | | 2/1974 | Carlson et al. | 55/288 |
| 3,881,215 | A | | 5/1975 | Krier et al. | 15/347 |
| 3,926,596 | A | | 12/1975 | Coleman | 15/352 |
| 4,007,026 | A | * | 2/1977 | Groh | 15/348 |
| 4,017,281 | A | | 4/1977 | Johnstone | 15/352 |
| 4,578,840 | A | | 4/1986 | Pausch | 15/352 |
| 4,660,248 | A | | 4/1987 | Young | 15/346 |
| 4,754,521 | A | * | 7/1988 | Zoni | 15/348 |
| 4,759,781 | A | | 7/1988 | Olson | |
| 4,884,313 | A | * | 12/1989 | Zoni | 15/348 |
| 5,006,136 | A | | 4/1991 | Wetter | 55/290 |
| 6,192,542 | B1 | | 2/2001 | Frederick et al. | 15/340.3 |
| 6,195,836 | B1 | | 3/2001 | Vanderlinden | 15/340.3 |
| 6,195,837 | B1 | * | 3/2001 | Vanderlinden | 15/348 |
| 2004/0020003 | A1 | * | 2/2004 | Strauser | 15/340.3 |
| 2004/0040104 | A1 | * | 3/2004 | Joynt et al. | 15/340.4 |

FOREIGN PATENT DOCUMENTS

| | | |
|---|---|---|
| DE | 12 56 241 B | 12/1967 |
| DE | 12 56 242 B | 12/1967 |
| EP | 0453177 | 11/1991 |
| WO | 03 069071 | 8/2003 |

OTHER PUBLICATIONS

Tennant Company, The Sentinel™ Power Sweeper marketing brochure (6 pages) (2003).

* cited by examiner

*Primary Examiner*—Theresa T. Snider
(74) *Attorney, Agent, or Firm*—Altera Law Group LLC

(57) ABSTRACT

A street sweeper with vacuumized dust control where a rotary broom chamber surrounds a rotary broom. The rotary broom chamber connects by a conveyor housing containing a conveyor mechanism to a hopper having a powered fan and a filter. A vacuum or low pressure is created within the hopper which communicates through the conveyor housing to the rotary broom chamber which creates an airflow therebetween which carries dust or other light debris to a filter which filters out the dust particles or other light debris. The conveyor housing and other components are positionable to accommodate various modes of operation.

31 Claims, 11 Drawing Sheets

STREET SWEEPER WITH VACUUMIZED DUST CONTROL

CROSS REFERENCES TO RELATED APPLICATIONS

None.

BACKGROUND OF THE INVENTION

1. Field of the Invention

The present invention is for a street cleaning device, and, more particularly, pertains to a street sweeper with vacuumized dust control.

2. Description of the Prior Art

Prior art street sweeper devices are often built on and about custom chassis not generally suited for economy of speed or having attributes geared toward desirable roadability qualities. Often such street sweepers include rotary sweeper brooms placed between the front wheel assemblies and special rear wheel drive or axle assemblies beneath a configured framework in an area often otherwise reserved for drive shafts and other framework members in conventional chassis, such as used for conventional trucks. Street sweepers utilizing truck chassis are also used for mounting of street sweeper components and are utilized for greater roadability and transport speed suitable for highway use. Some arrangements, such as rotary broom placement between the front wheel and rear wheel assemblies, are often limited, necessitating the use of smaller rotary brooms the dimensions of which are restricted by the available distance between the roadway and the chassis of the conventional truck. In the alternative, rotary sweeper brooms of larger size and better suitability can be located behind the rear axle at the rear portion of the truck chassis, as the upper region of the rotary broom is not generally limited by the chassis. Commonly, water is utilized to attempt to control dust in either configuration around and about the general area surrounding the street sweeper. The use of water is not always economical, water may not be readily available for dust control, large water flow may be required for effective dust control, thereby necessitating frequent refilling stops due to limited tank capacity, and the use of water at higher speeds may not be effective. Clearly, what is needed is a street sweeper having a method of road sweeper dust control which is not entirely dependent on the use of water and which can utilize a rotary broom located to the rearward of the rear street sweeper axle, such as is provided by the present invention.

SUMMARY OF THE INVENTION

The general purpose of the present invention is to provide a street sweeper with vacuumized dust control.

According to one embodiment of the present invention, there is provided a street sweeper with vacuumized dust control which mounts and secures to a chassis of a truck. A hopper, a conveyor mechanism, a conveyor housing, a rotary broom and a vacuumized chamber are arranged and mounted to the chassis of the truck. The rotary broom is located at the rear portion of the truck chassis adjacent to the lower end of the conveyor and conveyor housing and rearward of the rear street sweeper axle. Also located at, about and near the lower end of the conveyor and conveyor housing is a rotary broom shroud forming a rotary broom chamber capable of being vacuumized which surrounds the greater portion of the rotary broom. Components comprising the bottom edge of the rotary broom chamber and other components are in close proximity to and in intimate contact with the roadway. The upper end of the conveyor mechanism and the surrounding upper end of the conveyor housing sealingly connect to the upper region of the hopper. The hopper includes a fan air source and a filter for filtration of dust drawn into the hopper through the conveyor housing and for filtration of dust created by objects being deposited into the confines of and striking the sides or lower regions of the hopper. The fan is ducted to the rotary broom chamber by the interceding and sealingly connected conveyor housing. Rotary action of the fan creates a low pressure area or vacuum within the confines of the hopper which is ducted through the conveyor housing to provide an extended region of low pressure at the rotary broom chamber located about the rotary broom. Dust and other airborne materials of light weight which are dislodged or made to be airborne by action of the rotary broom are vacuumed and transferred by vacuum forces into the interior of the hopper where the airflow containing the dust is forced through the filter and where the lightweight materials either fall to the lower regions of the hopper or are made to come into contact with the filter. Airflow created by the fan also assists in urging lightweight debris, such as leaves, small paper items, and the like onto the conveyor for deposition in the hopper. Some dust or debris when not under the influence of vacuum air can be deposited on the conveyor by direct action of the rotary broom for subsequent deposition in the hopper. Heavier swept debris is deposited on the conveyor in a conventional manner and deposited into the hopper. Additionally, a transversely mounted water tank is also included for conventional use or for use in combination for dust control with the vacuum function if desired.

One significant aspect and feature of the present invention is a street sweeper with vacuumized dust control.

Another significant aspect and feature of the present invention is a street sweeper including components for vacuumized dust control which mounts on a truck chassis.

Still another significant aspect and feature of the present invention is a street sweeper which transports to sweeping locations at common highway speeds.

Another significant aspect and feature of the present invention is a rotary broom and rotary broom chamber located to the rearward of the street sweeper rear axle.

Yet another significant aspect and feature of the present invention is a street sweeper having a conveyor mechanism and a conveyor housing surrounding the conveyor mechanism.

A further significant aspect and feature of the present invention is a street sweeper where the conveyor housing sealingly aligns to a hopper receiver duct on the upper region of a hopper.

A still further significant aspect and feature of the present invention is a street sweeper where the conveyor housing aligns with and communicates with a rotary broom chamber surrounding a rotary broom.

A still further significant aspect and feature of the present invention is a street sweeper where a rotary broom chamber surrounding a rotary broom is in close proximity to and/or in intimate contact with the roadway.

Yet another significant aspect and feature of the present invention is a street sweeper having a rotary broom chamber including road following skids and attached positionable planar side plates.

A still further significant aspect and feature of the present invention is a street sweeper where an area of low pressure is presented around and about the area of contact of a rotary broom with the roadway whereby dislodged road dust and other light debris is carried by vacuum forces via a conveyor housing to a hopper for filtration.

A still further significant aspect and feature of the present invention is a rotary broom rotating against the path of intended sweeping to forwardly and upwardly project dirt and debris into the lower end of a conveyor mechanism for transport of the dirt and debris along the conveyor mechanism for subsequent deposit in a hopper.

Having thus described embodiments of the present invention and enumerated several significant aspects and features thereof, it is the principal object of the present invention to provide a street sweeper which features, in part, vacuumized dust control.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
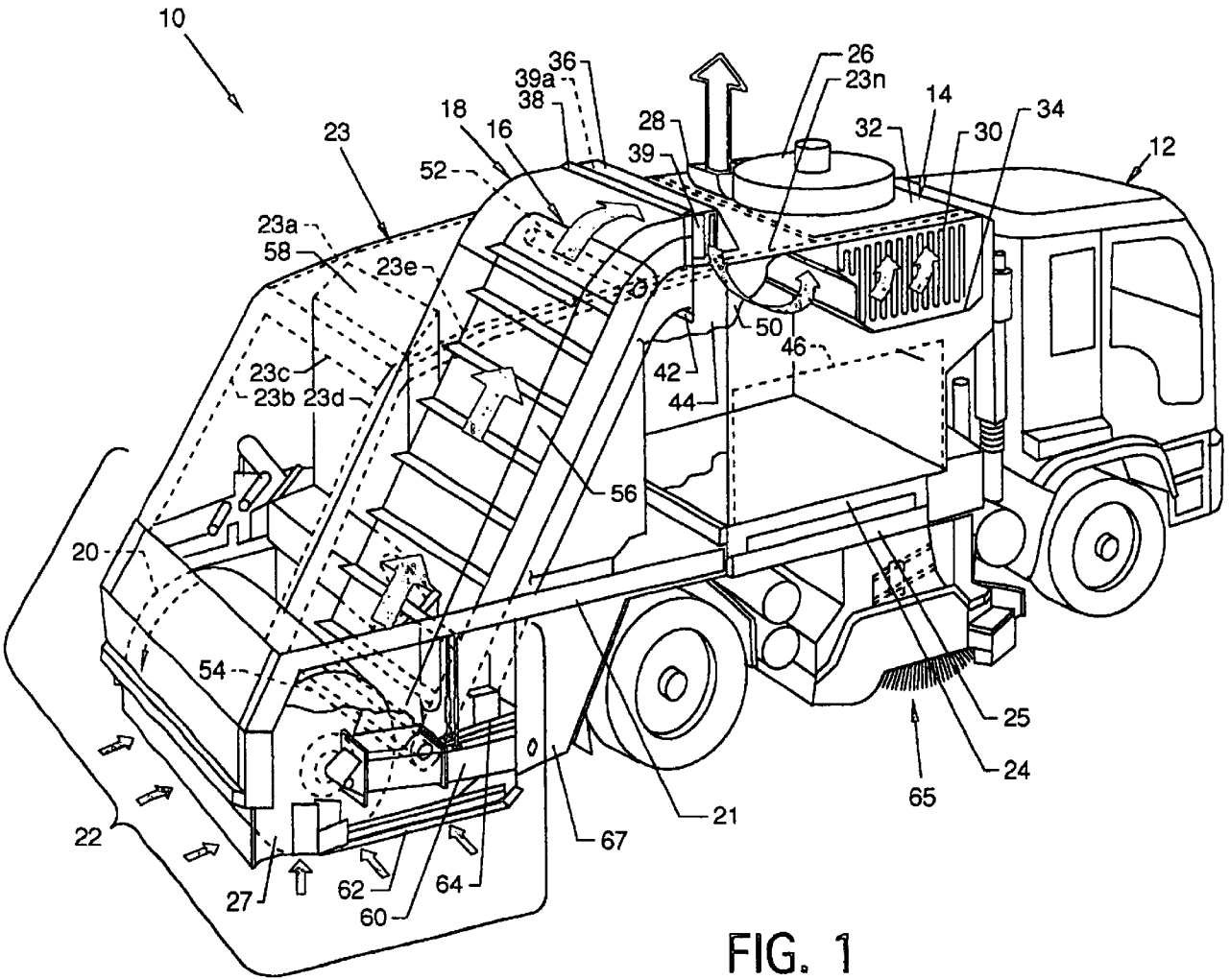
FIG. 1 illustrates a cutaway overview of a street sweeper, the present invention, which has vacuumized dust control.

FIG. 1 illustrates a cutaway overview of the street sweeper 10, the present invention, which has vacuumized duct control. Major and other components complementary to the invention are mounted to and secured to the frame or chassis 13 of a truck 12 or are mounted elsewhere at other locations about the invention. Major illustrated components of the invention include a hopper 14, a conveyor mechanism 16, a conveyor housing 18, a rotary broom 20 and a rotary broom chamber 22 which are arranged and mounted to the chassis 13 of the truck 12 or other frameworks in a position rearward of the street sweeper rear axle 17. Rearwardly extending frameworks 21 and 21*a* (FIG. 3) mount and secure to the chassis 13 of the truck 12 to accommodate a portion of the components of the invention. A superstructure framework 23 including a plurality of framework members 23*a*–23*n* is shown partially and generally in dashed lines extending upwardly and forwardly from the frameworks 21 and 21*a* to serve as structure for mounting of fixed panels or access panels or other devices as required.

Figure 2:
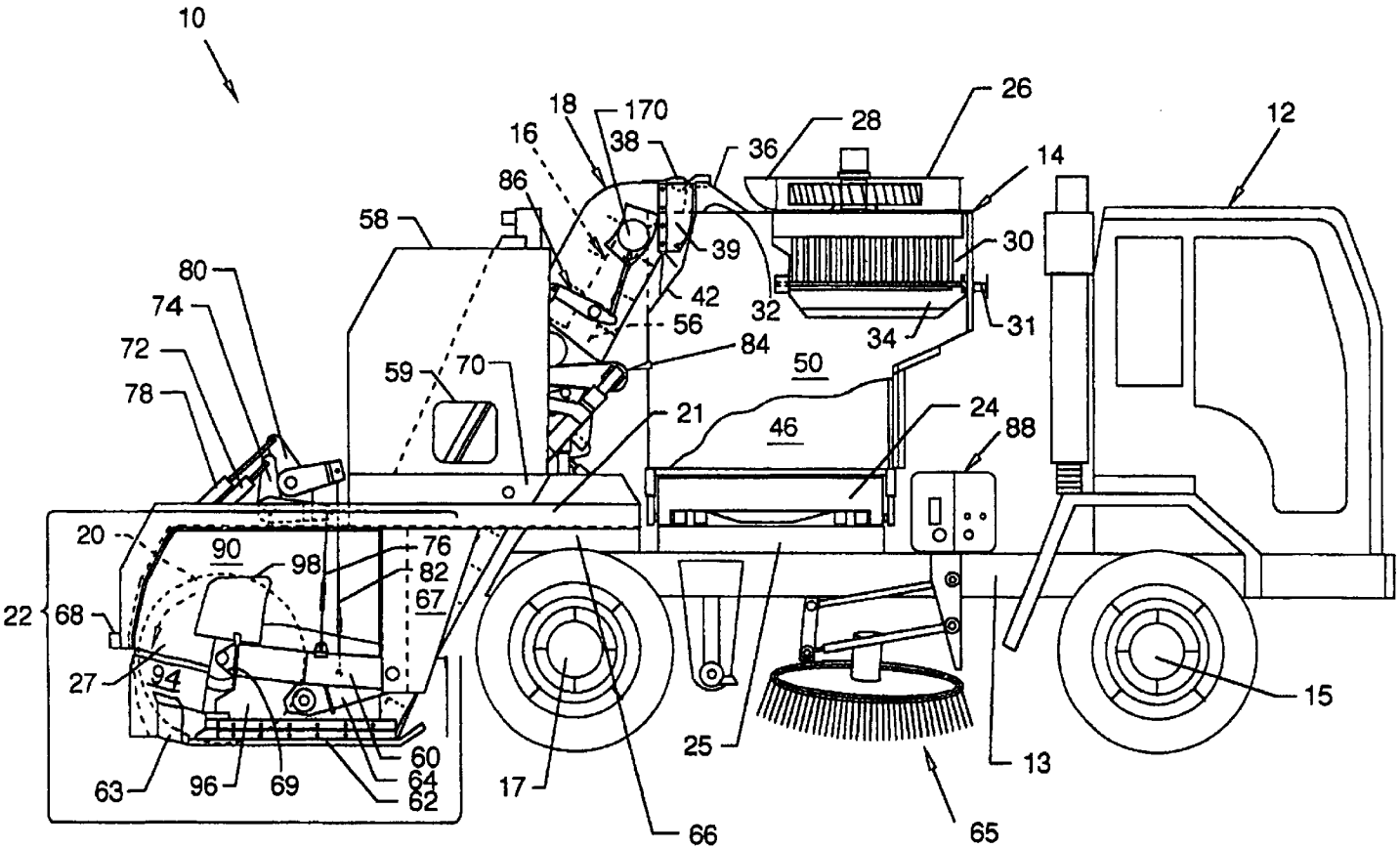
FIGS. 2 and 3 illustrate, in partial cutaway, opposing side views of the street sweeper.

The hopper 14 secures to the truck chassis 13 via a scissors jack assembly 24 which mounts to the truck chassis 13 via a scissors jack mounting frame 25. An air source consisting of a powered fan 26 having an exhaust port 28 and which is open to and which communicates through a filter 30 with the interior of the hopper 14 is attached to a hopper top panel 32. A plenum 34, also shown in FIG. 2, is located at the upper region of the hopper 14 and houses and partially supports the filter 30. The top of the filter 30 aligns substantially to the bottom surface of the hopper top panel 32 and to the bottom of the fan 26. The bottom of the filter 30 faces the interior of and communicates with the interior of the hopper 14. A receiver duct 36 mounts to the hopper top panel 32 to communicate with the interior of the hopper 14 and to sealingly connect with the elevated end of conveyor housing 18 surrounding the conveyor mechanism 16. A flexible seal 38 and opposing flexible side seals 39 and 39*a* and other seals located at the upper end of the conveyor housing 18 seal against components located at the inlet of the receiver duct 36, as shown in FIG. 2. An angled channel 42 is located in the vertically oriented hopper rear panel 44 for accommodation of the upper end of the conveyor mechanism 16. A hopper dump door 46 for emptying of the hopper 14 is located on the outwardly facing and vertically oriented hopper side panel 50 of the hopper 14.

The conveyor housing 18 and the conveyor mechanism 16, which is powered, are co-located, with the conveyor mechanism 16 being surrounded by the conveyor housing 18. An upper powered conveyor drive roller 52 mounts transversely across the upper region of the conveyor housing 18, and a lower powered conveyor drive roller 54 mounts transversely across the lower region of the conveyor housing 18. The conveyor mechanism 16 utilizes a cleated belt 56 or other suitable device to move debris deposited thereupon by action of the rotary broom 20, which rotates against the sweeping path into the confines of the hopper 14. The upper end of the conveyor mechanism 16 aligns to and extends along, through and beyond the angled channel 42 of the hopper rear panel 44 in order that debris can be off-loaded from the conveyor into the hopper 14. The lower end of the conveyor mechanism 16 extends downwardly and outwardly from the lower region of the conveyor housing 18 to juxtapose the rotary broom 20. The conveyor housing 18 extends for the most along and surrounds the upper portion of the conveyor mechanism 16 but terminates short of the lower end of the conveyor mechanism 16, thereby exposing the cleated belt 56 within the rotary broom chamber 22 to allow debris to be loaded on the cleated belt 56. The conveyor housing 18 and contained conveyor mechanism 16 are positionable according to the mode of operation of the invention. A transversely mounted geometrically configured water tank 58 (partially shown) extending over the top of the conveyor mechanism 16 and conveyor housing 18 is included to provide for a water supply, which may be connected to spray nozzles located appropriately about the truck chassis or other desired regions if the use of water is desired. The rotary broom 20 is supported at opposing ends by like and opposing pivotal broom support arms 60 and 60*a*

Figure 3:
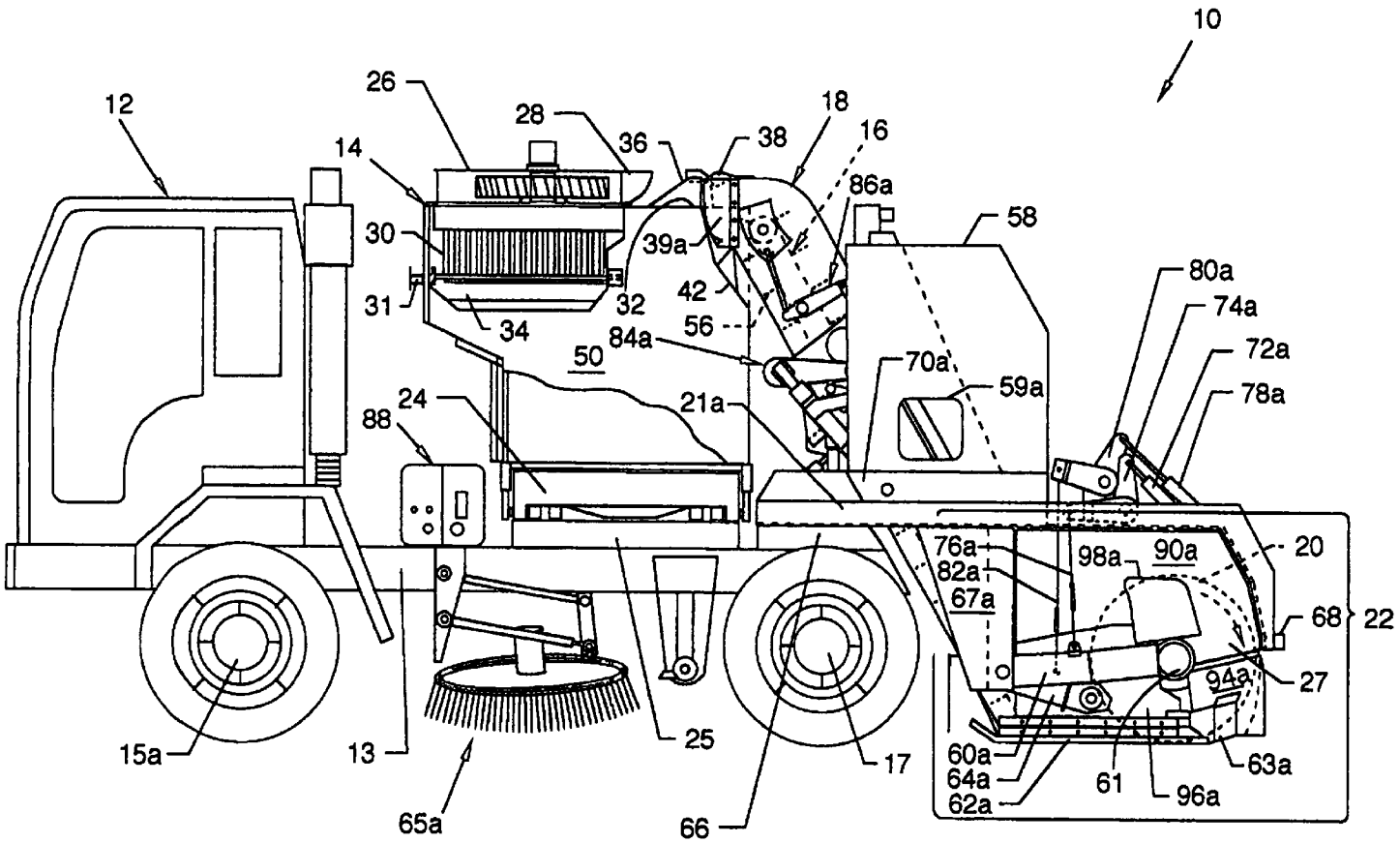

(FIG. 3). The drag shoe 62 and the opposing drag shoe 62*a* (FIG. 3) are supported by like and opposing pivotal drag shoe support arms 64 and 64*a* (FIG. 3). Support structures 67 and 67*a* (FIG. 3) extend downwardly from the chassis 13 to provide for pivotal support of the like and opposing pivotal broom support arms 60 and 60*a* and rotary broom 20 and for pivotal support of the like and opposing pivotal drag shoe support arms 64 and 64*a* and opposing drag shoes 62 and 62*a*, respectively. Optional gutter broom assemblies 65 and 65*a* (FIG. 3), including an optional surrounding structure, are mounted to the chassis 13 of the truck 12 and are shown without the surrounding structure when shown in the figures that follow.

FIGS. 2 and 3 illustrate, in partial cutaway, opposing side views of the street sweeper 10. In these views, the conveyor housing 18 containing the conveyor mechanism 16 is positioned in the sweep mode to best show the relationship of the upper region of the conveyor housing 18 and contained conveyor mechanism 16 with the upper and rearward region of the hopper 14. Other normal operating positions of the conveyor housing 18 and contained conveyor mechanism 16 are shown and described later in detail. In the illustrations and descriptions that follow, it is to be understood that the contained conveyor mechanism 16 is located for the most within the conveyor housing 18 and that the positioning of the conveyor housing 18 also includes the similar positioning of the contained conveyor mechanism 16 located therein.

Frameworks 21 and 21*a* mount to the chassis 13 of the truck 12 via a mounting structure 66 mounted transversely to the chassis 13. Frameworks 21 and 21*a* extend rearwardly and then downwardly to terminate near the rearward and outward edges of the rotary broom 20. A rear bumper 68 extends, as do other structural members, transversely between the ends of the framework 21 and the opposing corresponding framework 21*a*. Framework 70 in the form of a box tube or other suitable structure secures in longitudinal orientation to and along the inner surface of the framework 21 and to other members as required, as does another opposing framework 70*a* to the inner surface of the framework 21*a*. Opposing frameworks 70 and 70*a* are for the most incorporated for support of the conveyor housing 18, as later described in detail. A forward axle 15 and a rear axle 17 mount to the chassis 13 of the truck 12.

Opposing pivotal broom support arms 60 and 60*a* and opposing pivotal drag shoe support arms 64 and 64*a*, respectively, are positionally pivoted by opposed sets of lifting/lowering cylinders, bell cranks and cables to position the rotary broom 20 and opposing drag shoes 62 and 62*a*, respectively. Respectively, broom lift/lower cylinders 72 and 72*a* attach separately to bell cranks 74 and 74*a*, and cables 76 and 76*a* attach between bell cranks 74 and 74*a* and the pivotal broom support arms 60 and 60*a* to control the vertical position of the rotary broom 20. Respectively, drag shoe lift/lower cylinders 78 and 78*a* attach separately to bell cranks 80 and 80*a*, and cables 82 and 82*a* attach between bell cranks 80 and 80*a* and the pivotal drag shoe support arms 64 and 64*a* to control the vertical position of the drag shoes 62 and 62*a*. Drag shoes 62 and 62*a* in part comprise the rotary broom chamber 22 in concert with other components described herein. A bracket 69 (FIG. 2) on one end of the pivotal broom support arm 60 supports one end of the rotary broom 20. The opposing end of the rotary broom 20 is supported by a hydraulic drive motor assembly 61 (FIG. 3) which powers the rotary broom 20. Geometrically configured and substantially vertically oriented plates 63 (FIG. 2) and 63*a* mount to the trailing portions of the drag shoes 62 (FIG. 2) and 62*a*, respectively. Plates 63 (FIG. 2) and 63*a* serve as guides or stops for flexible side panels 94 and 94*a* shown in FIGS. 4 and 5.

Additionally shown in FIGS. 2 and 3 are conveyor/conveyor housing mount assemblies 84 and 84*a*, conveyor belt tensioner assemblies 86 and 86*a*, and a hydraulic fluid tank 88, which are described later in detail. Also shown in the views is the water tank 58 which mounts transversely across the frameworks 70 and 70*a*. The water tank 58 includes access holes 59 and 59*a* extending through the right and left sides, respectively, for access to conveyor belt tensioner assemblies 86 and 86*a* shown in FIGS. 2, 3, 4 and 5. A filter shaker mechanism 31 is mounted in the hopper 14 to communicate with and actuate the bottom of the filter 30 to clean the filter 30 when the filter 30 is blocked to such a degree that not enough air is passing through the filter 30 for filtration.

Figure 4:
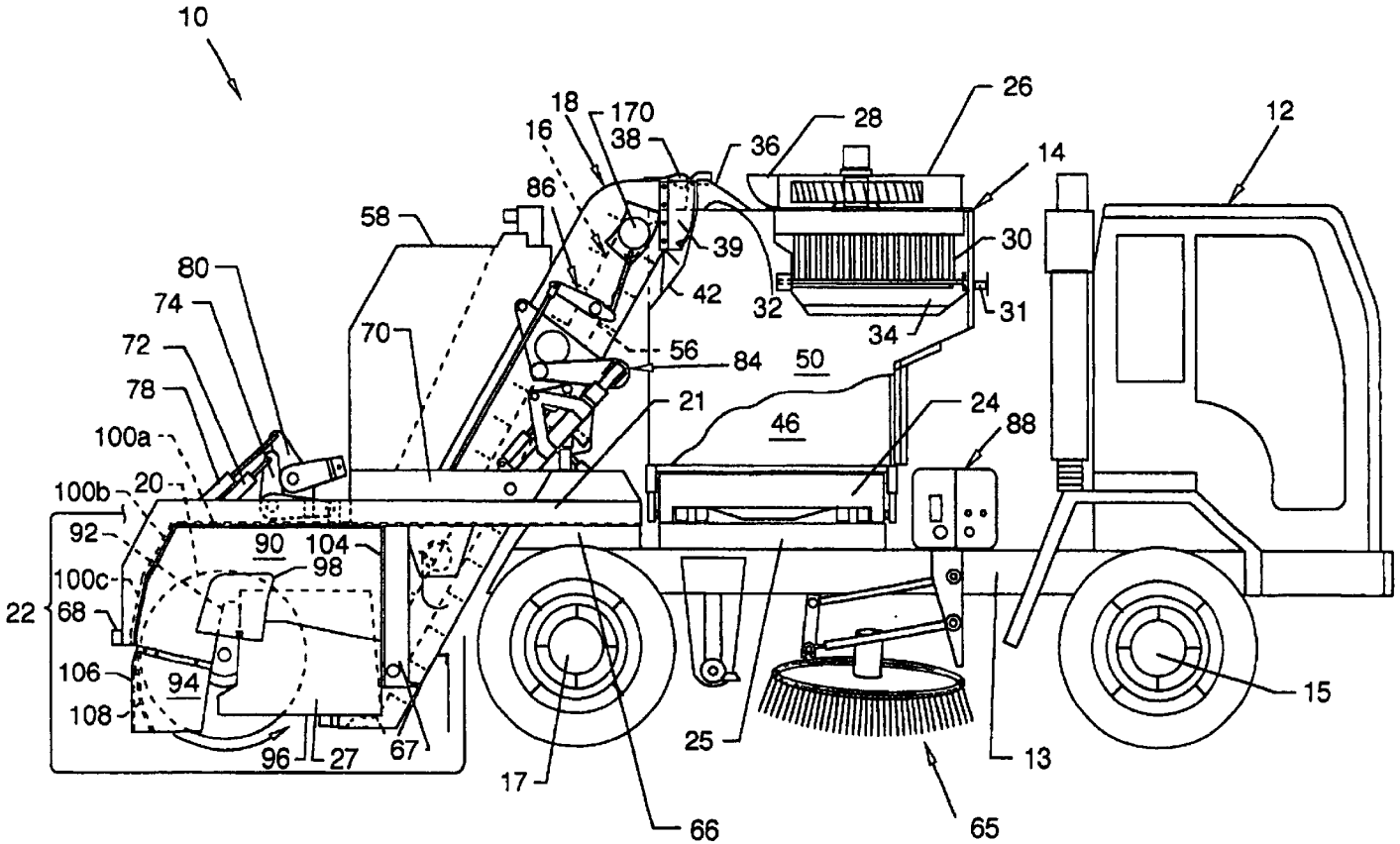
FIGS. 4 and 5 illustrate, in partial cutaway, opposing side views of the street sweeper where the pivotal broom support arms, the pivotal drag shoe support arms, the drag shoes, the plates, the cables, and the outer coverings of the support structures have been removed to reveal, in part, other components comprising the rotary chamber.
Figure 5:
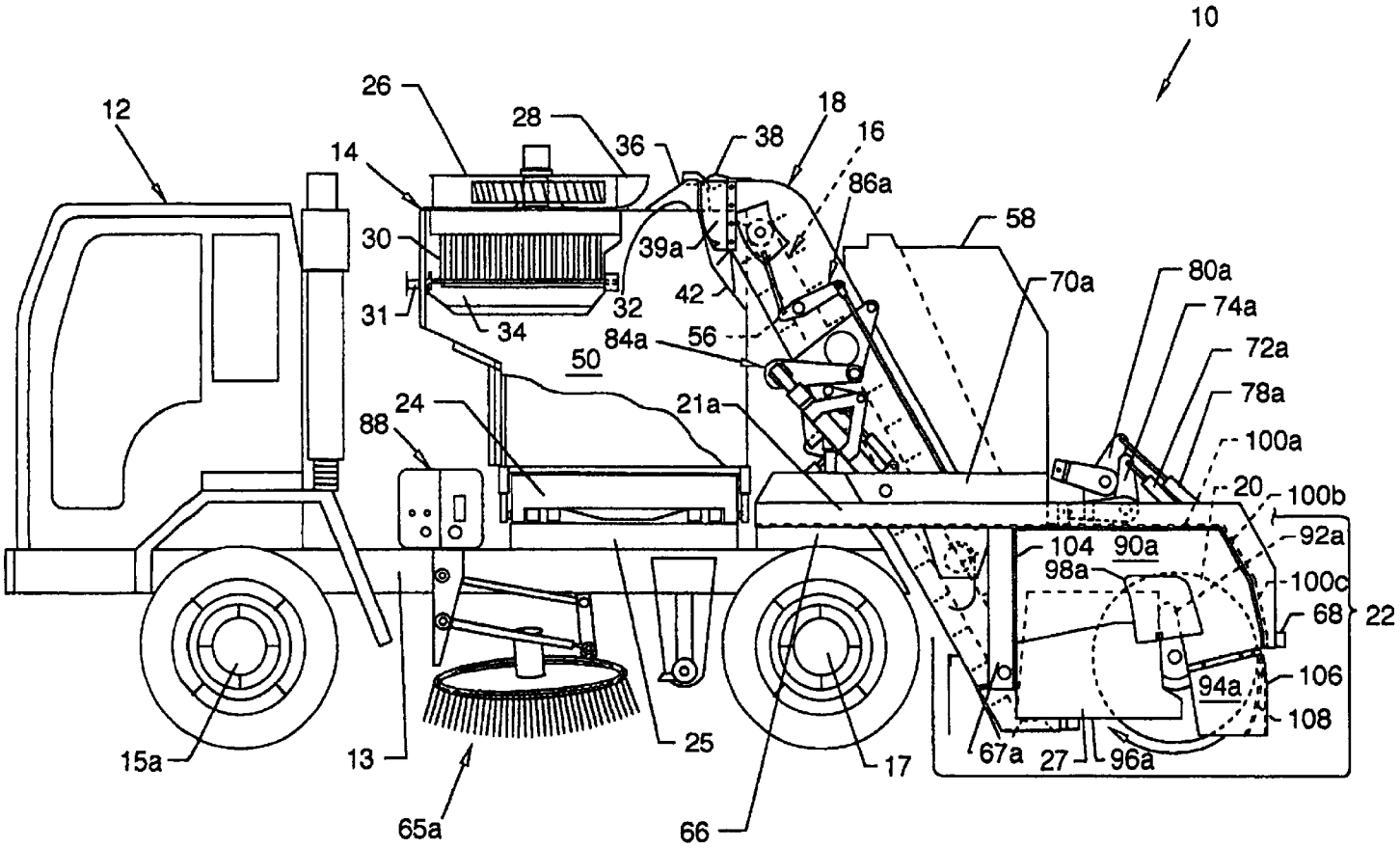

FIGS. 4 and 5 illustrate, in partial cutaway, opposing side views of the street sweeper 10 where the pivotal broom support arms 60 and 60*a*, the pivotal drag shoe support arms 64 and 64*a*, the drag shoes 62 and 62*a*, the plates 63 and 63*a*, the cables 76, 76*a*, 82 and 82*a*, and the outer coverings of the support structures 67 and 67*a* have been removed to reveal, in part, other components comprising components of a shroud 27 which form rotary broom chamber 22. In FIG. 4 the right side of the configured water tank 58 is not shown in order to reveal components of and associated with the mounting of the conveyor housing 18; and in FIG. 5 the left side of the configured water tank 58 is not shown. Additional components, comprising, in part, the shroud 27 forming the rotary broom chamber 22, include corresponding opposed vertically oriented panels located generally adjacent to the opposing ends of the rotary broom 20, are clearly shown. Opposing vertically oriented fixed non-flexible panels 90 and 90*a* having slots 92 and 92*a*, respectively, being a portion of the shroud 27, secure to and extend from the frameworks 21 and 21*a*. Opposing vertically oriented flexible side panels 94 and 94*a* of the shroud 27 secure to and extend downwardly from the rear and lower edge of the fixed non-flexible panels 90 and 90*a* of the shroud 27. Opposing vertically oriented non-flexible panels 96 and 96*a*, which attach to and move with the upper region of the drag shoes 62 and 62*a*, respectively (FIGS. 2 and 3), align partially behind and with near juxtaposition with the fixed non-flexible panels 90 and 90*a* to form, in part, shroud 27. Vertically oriented non-flexible panels 98 and 98*a*, part of shroud 27, secure to the upper and rear region of and move with the pivotal broom support arms 60 and 60*a* (FIGS. 2 and 3) to transitionally cover the greater region of the slots 92 and 92*a* in fixed non-flexible panels 90 and 90*a*. Additional components, comprising, in part, the shroud 27 which forms the rotary broom chamber 22, include transversely mounted fixed panels 100*a*, 100*b* and 100*c*, shown in dashed lines, extending between the frameworks 21 and 21*a*. A vertically oriented transversely mounted fixed panel 104 extends downwardly from the frameworks 21 and 21*a* to comprise in part the support structure 67 and 67*a*. In addition and as part of the shroud 27, vertically oriented transversely mounted flexible panels 106 and 108 extend downwardly from the fixed panel 100*c* and in transversal mounting between the lower regions of the frameworks 21 and 21*a* to comprise in part the shroud 27 forming the rotary broom chamber 22.

Figure 6:
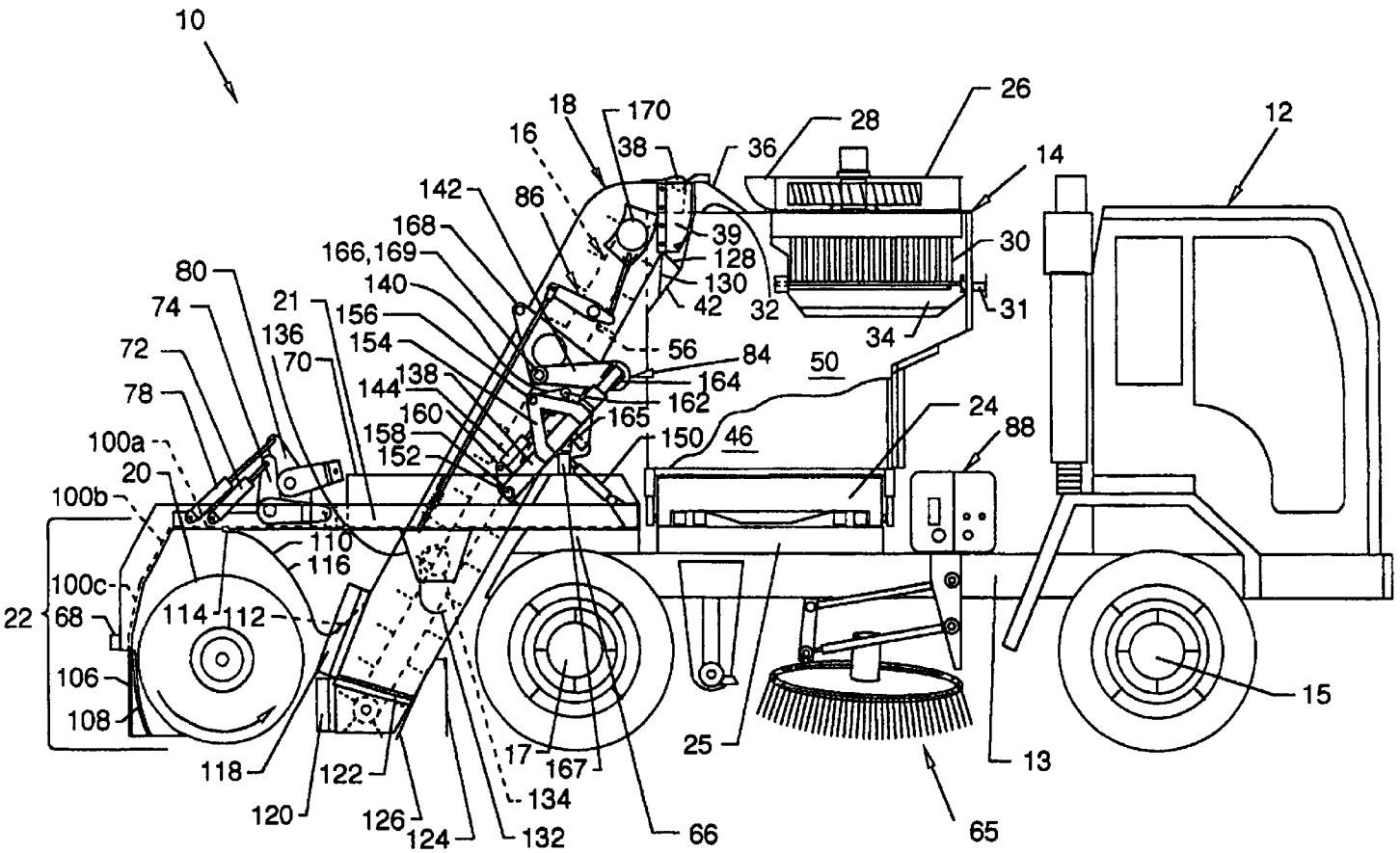
FIGS. 6 and 7 illustrate, in partial cutaway, opposing side views of the street sweeper where additional components including flexible side panels, fixed non-flexible panels, and non-flexible panels have been removed to reveal, in part, other components comprising the rotary broom chamber.
Figure 7:
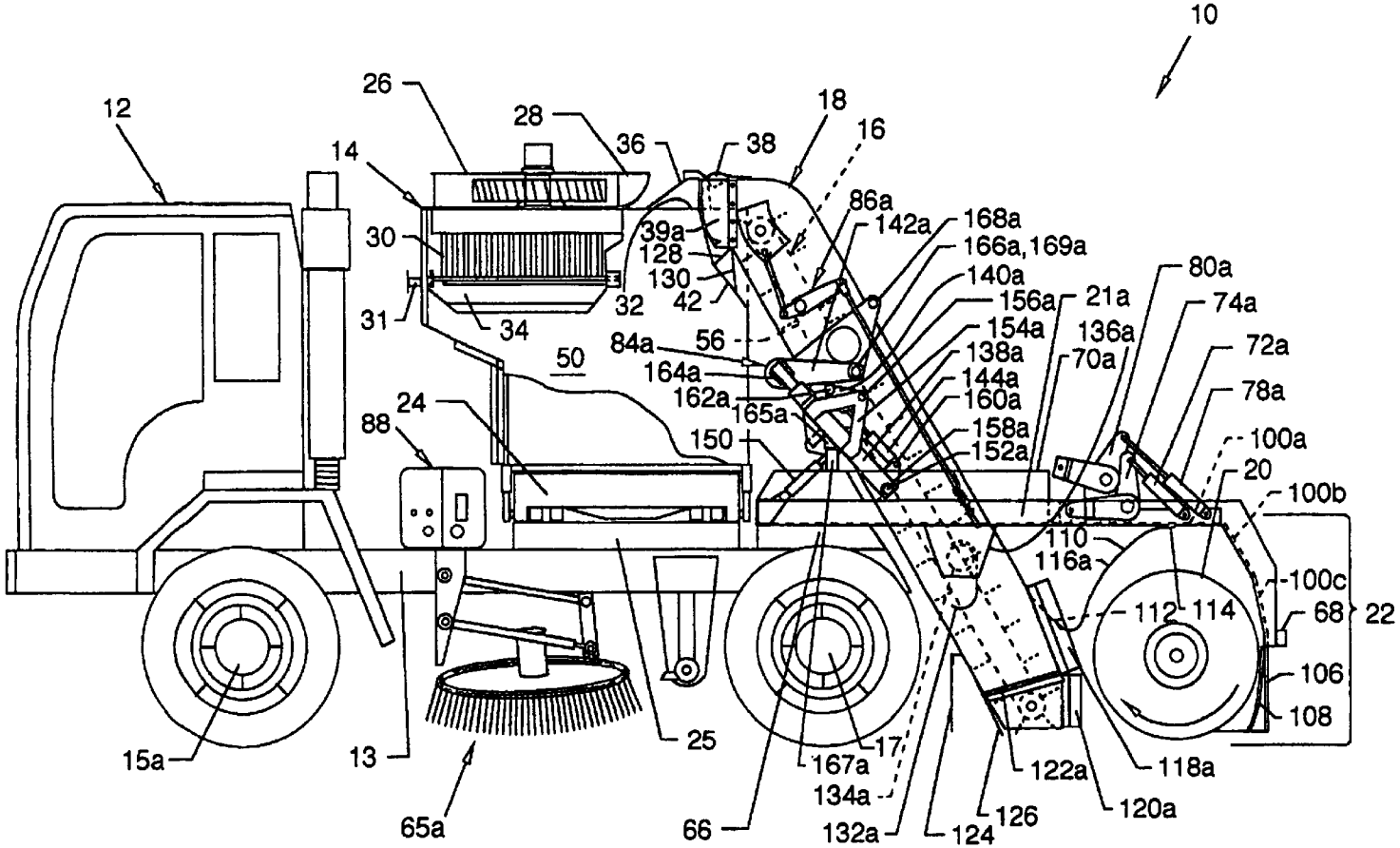

FIGS. 6 and 7 illustrate, in partial cutaway, opposing side views of street sweeper 10 where additional components including flexible side panels 94 and 94*a*, fixed non-flexible panels 90 and 90*a*, non-flexible panels 96 and 96*a*, and non-flexible panels 98 and 98*a* have been removed to reveal, in part, other components comprising the shroud 27 forming the rotary broom chamber 22. Also shown in the views are additional seal members and components incorporated to mount and/or suspend the conveyor housing 18 and contained conveyor mechanism 16.

A large transversely extending flexible seal 110 of suitable rubber, plastic or the like comprises, in part, the shroud 27 forming the rotary broom chamber 22. The forward edge 112 of the flexible seal 110 secures in transverse fashion to the lower portion of the conveyor housing 18, and the rearward edge 114 secures in transverse fashion to the underside of the fixed panel 100*a*, thereby utilizing the rear portion of the fixed panel 100*a* to comprise, in part, the shroud 27 forming the rotary broom chamber 22. The large flexible seal 110 also includes outwardly facing edges 116 and 116*a* which align interfacingly and in perpendicular fashion in close proximity or having intimate contact with the non-flexible panels 96, 96*a*, 90 and 90*a*, respectively, to comprise, in part, the shroud 27 forming the rotary broom chamber 22. Also extending outwardly from the lower region of the conveyor housing 18 are flexible panels 118, 118*a*, 120, 120*a*, 122 and 122*a* which align interfacingly and sealingly in close proximity or having intimate contact with non-flexible panels 96 and 96*a*, respectively, to comprise, in part, the shroud 27 forming the rotary broom chamber 22. Also extending outwardly from the lower and forward region of the conveyor housing 18 are transversely mounted flexible slotted panels 124 and 126 which act as a double seal against and to the roadway and which comprise, in part, the shroud 27 forming the rotary broom chamber 22. Transversely mounted flexible panels 128 and 130 at the upper region of the conveyor housing 18 assist flexible side seals 39 and 39*a* and flexible seal 38 to seal the upper end of the conveyor housing 18 to the receiver duct 36 and the areas adjacent to the receiver duct 36 to ensure a sealed and a flexible coupled connection of the upper region of the conveyor housing 18 to the interior of the hopper 14.

Figure 8:
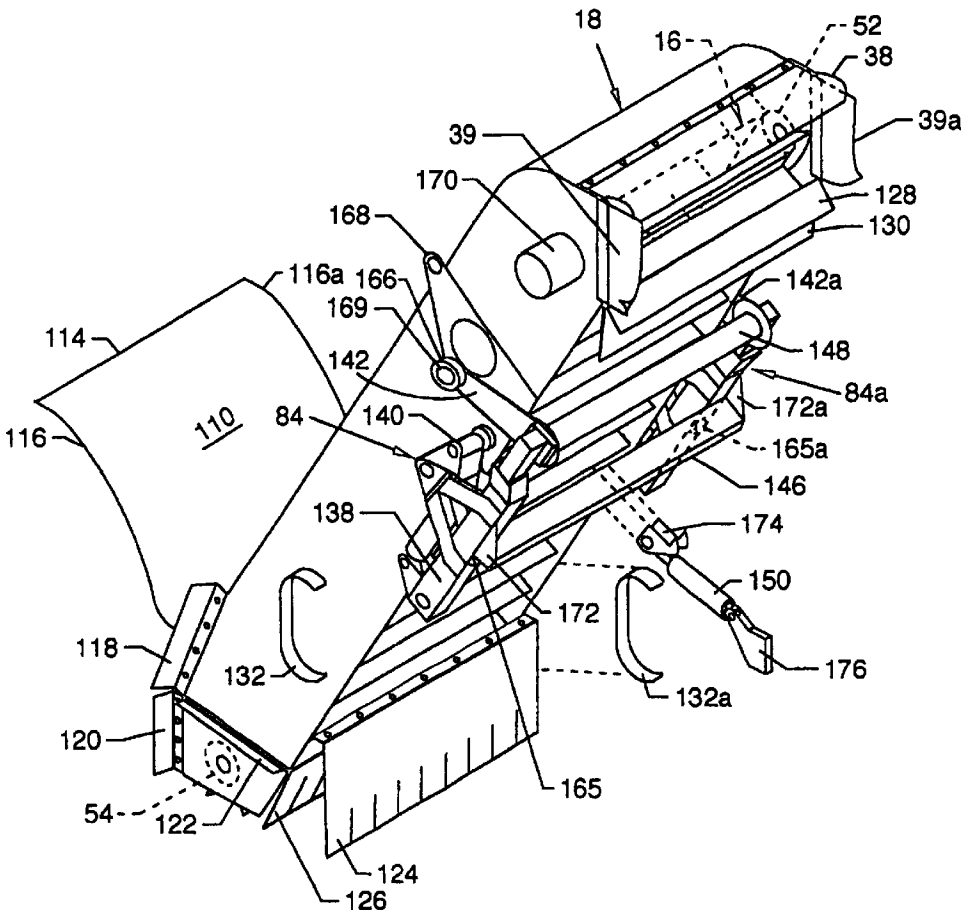
FIG. 8 illustrates an isometric view of the conveyor housing and other components associated therewith.

The conveyor housing 18 aligns transversely and indirectly between the frameworks 21 and 21*a* and aligns directly between the frameworks 70 and 70*a* and extends vertically therebetween in angular alignment and can be positioned as required with respect to the vertical and horizontal by the conveyor/conveyor housing mount assemblies 84 and 84*a* which utilize hydraulics to provide such movement. Other components which can influence the position of the conveyor housing 18 include opposing vertically oriented C-channels 132 and 132*a*, as also viewed in FIG. 8, which secure to the opposing sides of the conveyor housing 18 and include, respectively, opposing solid cylindrical pucks 134 and 134*a* mounted on the inwardly facing surfaces of fixed brackets 136 and 136*a* extending downwardly from the frameworks 70 and 70*a*. The conveyor housing 18 is illustrated in the sweep mode and, as such, the conveyor housing 18 is supported in part by the engagement of the pucks 134 and 134*a* with the upper curved regions of the C-channels 132 and 132*a*, thereby lending support at the lower region of the conveyor housing 18. The conveyor/conveyor housing mount assemblies 84 and 84*a* connect to and in various modes of operation actively or passively support, in part, the upper region of the conveyor housing 18 and are interconnected, as shown in FIG. 8, to offer variable geometry active or passive support of the conveyor housing 18 at the upper region of the conveyor housing 18 during certain modes of operation, as described later in detail. During passive support (sweep mode), the conveyor/conveyor housing mount assemblies 84 and 84*a* are not influenced by hydraulic forces and offer lateral structural support in part. During passive support involvement by the conveyor/conveyor housing mount assemblies 84 and 84*a*, such as in the sweep mode, angled supports 165 and 165*a* on the lower surfaces of configured pivot bars 138 and 138*a* of the conveyor/conveyor housing mount assemblies 84 and 84*a* are in intimate supporting contact with vertically aligned support blocks 167 and 167*a* which mount to the frameworks 70 and 70*a* to offer lateral support and vertical support of the upper region of the conveyor housing 18.

The conveyor/conveyor housing mount assemblies 84 and 84*a* feature major components including geometrically configured pivot bars 138 and 138*a*, rollered arm assemblies 140 and 140*a*, arms 142 and 142*a*, and actuating cylinders 144 and 144*a*. The conveyor/conveyor housing mount assemblies 84 and 84*a* are transversely connected by a box tube 146 and a tube 148 and actuated and positioned in part by a hydraulic actuating cylinder 150, all shown in FIG. 8. The bottom ends of the pivot bars 138 and 138*a* engage and can pivot about pivot pins 152 and 152*a* which are mounted through and extend inwardly from frameworks 70 and 70*a*. Yoke-like brackets 154 and 154*a*, being opposing substantially V-shaped members, opposingly attach to the opposing vertically oriented sides of the pivot bars 138 and 138*a* to serve as pivotal mounting structures for the rollered arm assemblies 140 and 140*a* which attach between the opposing V-shaped members of the yoke-like brackets 154 and 154*a* by pivot pins 156 and 156*a*. One end of the actuating cylinders 144 and 144*a* pivotally attach by pivot pins 160 and 160*a* to brackets 158 and 158*a* which attach to and extend upwardly from the lower region of the pivot bars 138 and 138*a*. The other ends of the actuating cylinders 144 and 144*a* pivotally secure in suitable fashion to the rollered arm assemblies 140 and 140*a* to hydraulically pivot the rollered arm assemblies 140 and 140*a* about the pivot pins 156 and 156*a*. Rollered arm assemblies 140 and 140*a* include rollers 162 and 162*a* which can be urged by hydraulic action into contact with the lower edges of the arms 142 and 142*a* to influence the substantially vertical position of the conveyor housing 18 and contained conveyor mechanism 16 as required. The upper ends of the pivot bars 138 and 138*a* pivotally attach via bearing assemblies 164 and 164*a* to the forward ends of the arms 142 and 142*a*. The rearward ends of the arms 142 and 142*a* incorporate bearinged mount fixtures 166 and 166*a* which pivotally secure the arms 142 and 142*a* to pivot pins 169 and 169*a* extending from the opposing sides of the conveyor housing 18. Opposing lifting lugs 168 and 168*a* are secured to the vertical sides of the conveyor housing 18. A hydraulic motor 170 shown on the near side of the conveyor housing 18 powers the conveyor mechanism 16. Other components associated with the conveyor/conveyor housing mount assemblies 84 and 84*a* are shown in and described in relation to FIG. 8.

FIG. 8 illustrates an isometric view of the conveyor housing 18 and other components associated therewith. Illustrated in particular is the interconnection of the conveyor/conveyor housing mount assemblies 84 and 84*a* by the box tube 146 and by the tube 148 extending therebetween. Tube 148 extends between the forward ends of the arms 142 and 142*a* to provide connective association between the upper regions of the conveyor/conveyor housing mount assemblies 84 and 84*a*. Brackets 172 and 172*a* extend forwardly from the pivot bars 138 and 138*a* to accommodate the box tube 146 which extends therebetween to provide connective association between the lower regions of the conveyor/conveyor housing mount assemblies 84 and 84*a*. Another bracket 174 is shown distanced from and secures to the mid portion of the box tube 146. One end of the hydraulic actuating cylinder 150 pivotally secures to the bracket 174 and the other end pivotally secures to a bracket 176 which in turn secures to a framework member. Bracket 174 secures to the box tube 146.

MODE OF OPERATION

The preceding figures have best shown and described the structure of the street sweeper 10 in the sweep mode. Hydraulic operating power is provided by one or more truck mounted hydraulic pumps, filters and coolers and appropriately routed by hydraulic controls (not shown) for operation of hydraulically operated components, such as, but not limited to, the fan 26, the hydraulic drive motor assembly 61, the gutter broom assemblies 65 and 65*a*, the broom lift/lower cylinders 72, 72*a*, the drag shoe lift/lower cylinders 78, 78*a*, the actuating cylinders 144, 144*a* and 150, and the hydraulic motor 170. During the sweep mode, the deflection mode, the transit mode or the dump mode various components are positioned or operated or are not operated to meet the need of that particular mode of operation, as described in detail herein.

During the sweep mode, gutter broom assemblies 65 and 65*a* are powered and utilized to sweep and direct debris to the center of the travel path of the truck 12 and into the path of the forwardly advancing rotary broom 20. The rotary broom 20 sweepingly directs debris forwardly and upwardly to be deposited on the lower receiving end of conveyor mechanism 16 for conveyance to the hopper 14 which is surrounded by the conveyor housing 18. During the sweep mode, the rotary broom 20 is positioned vertically by action of the broom lift/lower cylinders 72 and 72*a*, bell cranks 74 and 74*a*, cables 76 and 76*a*, and pivotal broom support arms 60 and. 60*a* for suitable and appropriate sweeping contact with the roadway. Suitable cable tension can be maintained to limit downward gravitational movement of the rotary broom 20 to control rotary broom force, as desired. The nonflexible panels 98 and 98*a* attached to the pivotal broom support arms 60 and 60*a* correspondingly position along the slots 92 and 92*a* in the fixed nonflexible panels 90 and 90*a* and along nonflexible panels 96 and 96*a* to maintain vacuumized integrity of the rotary broom chamber 22. Drag shoes 62 and 62*a* are positioned vertically by action of the drag shoe lift/lower cylinders 78 and 78*a*, bell cranks 80 and 80*a*, cables 82 and 82*a*, and pivotal drag shoe support arms 64 and 64*a* for suitable and appropriate sliding contact with the roadway. Suitable cable tension can be maintained to limit downward gravitational movement of the drag shoes 62 and 62*a*, as desired. Nonflexible panels 96 and 96*a* attached to the drag shoes 62 and 62*a* correspondingly position along the fixed nonflexible panels 90 and 90*a* and nonflexible panels 98 and 98*a* to maintain vacuumized integrity of the rotary broom chamber 22. During the sweep mode, the conveyor housing 18 containing the conveyor mechanism 16 is supported, as previously described in relation to FIGS. 6 and 7, and by support blocks 167 and 167*a* and by the pucks 134 and 134*a* with the assistance of gravitational forces. The conveyor/conveyor housing mount assemblies 84 and 84*a* offer passive support of the conveyor housing 18 in the sweep mode.

In the sweep mode the fan 26 is utilized to create a region of low pressure, or vacuum, which communicates through the conveyor housing 18 with the vacuumized chamber 22 surrounding the rotary broom 20 to maintain an area of low pressure or vacuum in the rotary broom chamber 22. Air containing dust particles, as shown by dark arrows (FIG. 1), is drawn through the areas of increasingly lower pressures from the vacuumized chamber 22, through the conveyor housing 18, through the hopper 14 and thence into and through the filter 30 and fan 26 for filtration, and then exiting the exhaust port 28 as filtered clean air, as shown by a light arrow.

Figure 9:
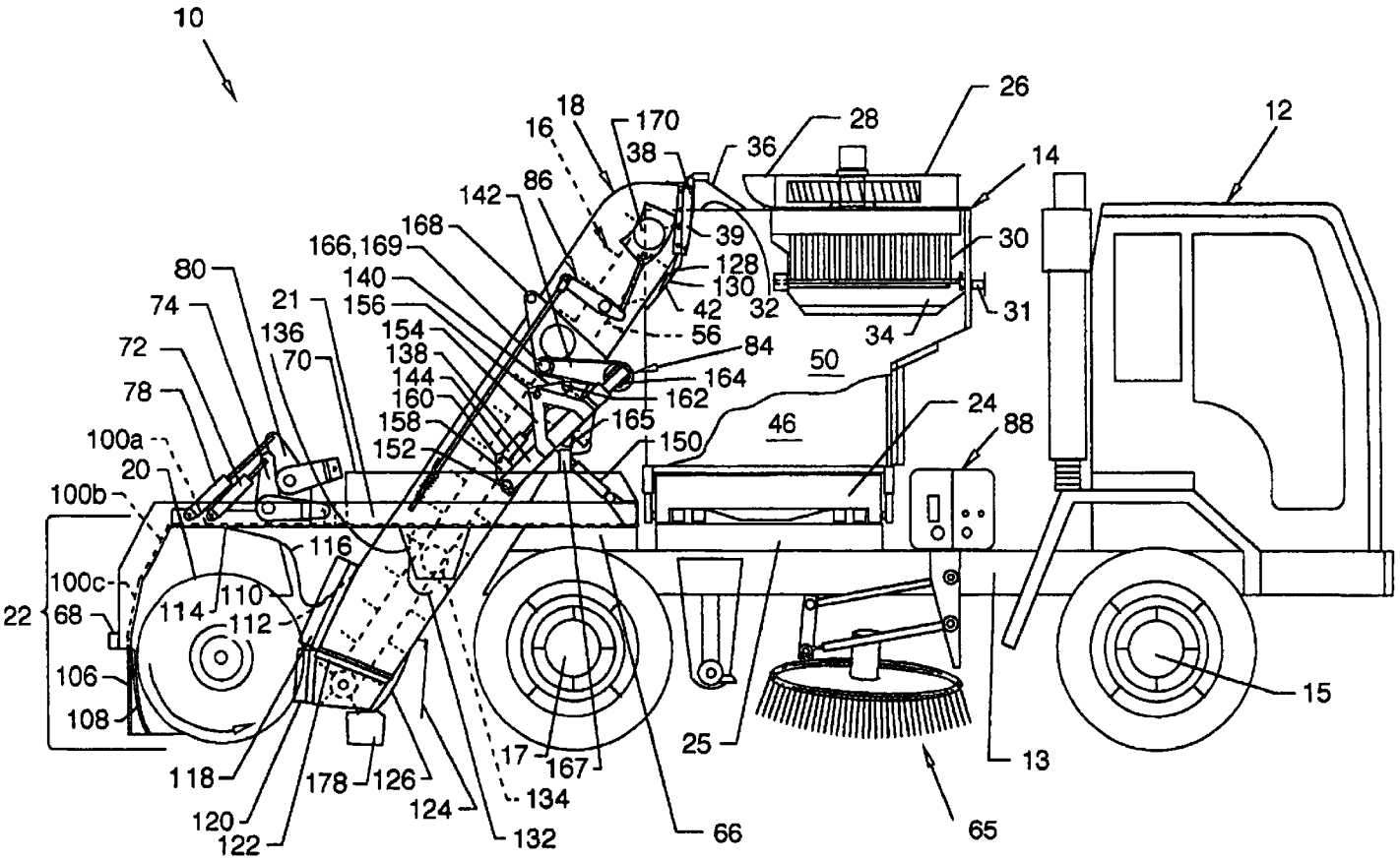
FIG. 9 illustrates the deflection mode, whereby the lower region of the conveyor housing encounters an obstacle while primarily engaged in the sweep mode.

FIG. 9 illustrates the deflection mode, whereby the lower region of the conveyor housing 18 encounters an obstacle 178 while primarily engaged in the sweep mode. During such an encounter, the conveyor housing 18 can accommodatingly pivot or otherwise reposition to avoid damage to the structure of the invention. Pivoting occurs and centers about the junction of the angled supports 165 and 165*a* with the support blocks 167 and 167*a* or, in the alternative, the conveyor housing 18 can be repositioned to a position where intimate engagement of the angled supports 165 and 165*a* with the support blocks 167 and 167*a* no longer occurs. At such a time the pucks 134 and 134*a* disengage from the C-channels 132 and 132*a*. The conveyor/conveyor housing mount assemblies 84 and 84*a* offer passive support of the conveyor housing 18 during the deflection mode.

Figure 10:
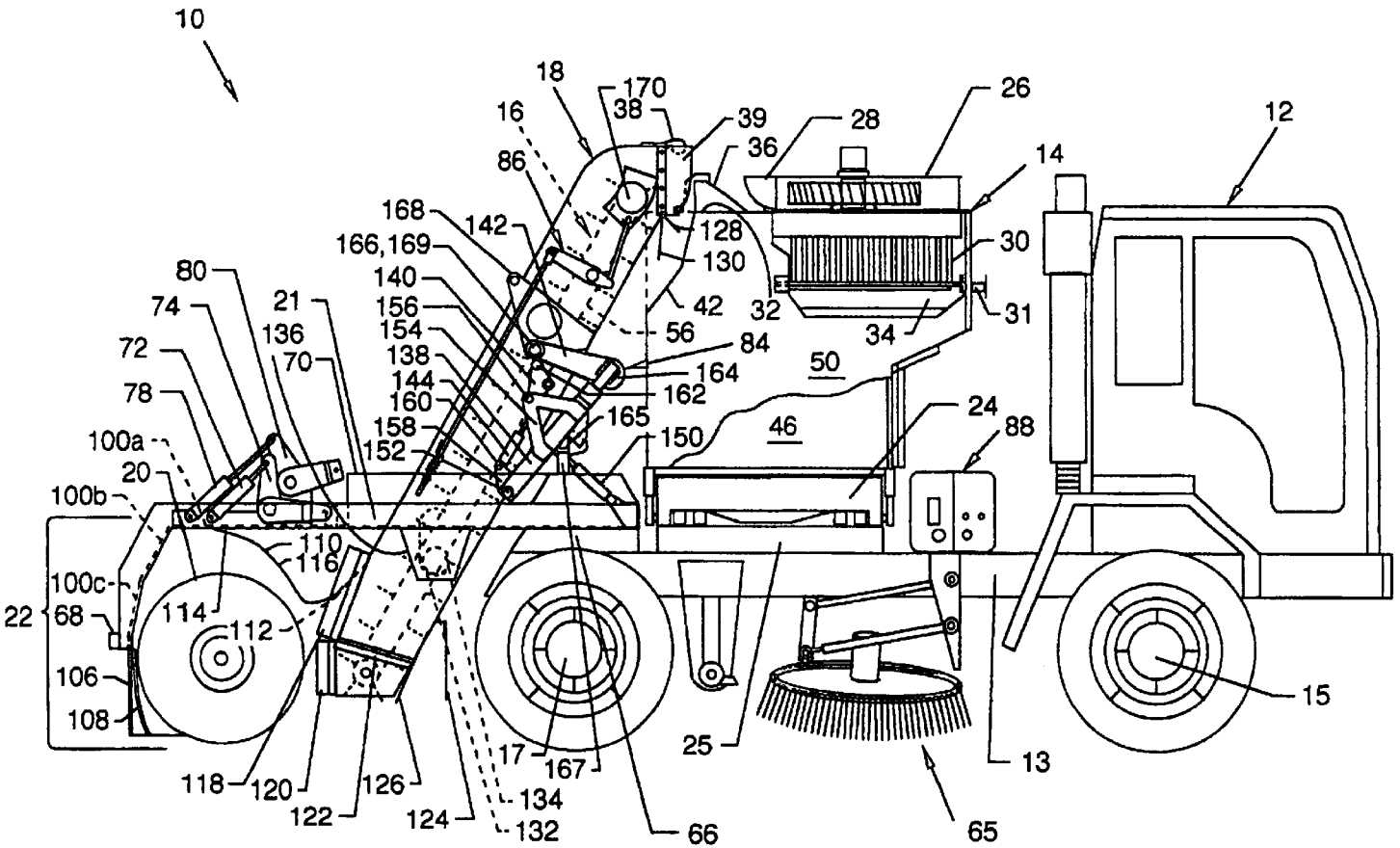
FIG. 10 illustrates the transit mode, whereby the conveyor housing is raised to allow high speed transit of the street sweeper along the roadway to a sweeping site; and, FIG. 11 illustrates the dump mode, whereby the conveyor housing is raised and positioned rearwardly to accommodate removal of debris and subsequent depositing of the debris to an adjacently positioned truck from an elevated hopper.

FIG. 10 illustrates the transit mode, whereby the conveyor housing 18 is raised to allow high speed transit of the street sweeper 10 along the roadway to a sweeping site. In the transit mode, the upper region of the conveyor housing 18 is actively influenced by the conveyor/conveyor housing mount assemblies 84 and 84*a* which are instrumental in the elevating of the conveyor housing 18 to a position where the lower region of conveyor 18 is distanced from the roadway. Actuating cylinders 144 and 144*a*, part of the conveyor/conveyor housing mount assemblies 84 and 84*a*, are powered and extend to pivotally position the rollered arm assemblies 140 and 140*a* and thus cause the rollers 162 and 162*a* to forcibly engage the lower edges of arms 142 and 142*a*. Such forced engagement pivots the arms 142 and 142*a* upwardly about the bearing assemblies 164 and 164*a* to carry and position the conveyor housing 18 in an upward direction. The pivot bars 138 and 138*a* remain stationary with respect to the conveyor housing 18 and are supported in part by the angled supports 165 and 165*a* and the support blocks 167 and 167*a* which remain in intimate contact during the transit mode. As the conveyor housing 18 is first elevatingly influenced by the conveyor/conveyor housing mount assemblies 84 and 84*a*, the pucks 134 and 134*a* disengage from the upper portion of the C-channels 132 and 132*a* and remain disengaged until reaching and contacting the lower region of the C-channels 132 and 132*a* upon which supportive re-engagement occurs with the lower region of the C-channels 132 and 132*a* to support and stabilize the lower region of the conveyor housing 18. Repositioning of the conveyor 18 also repositionally disengages the upper region of the conveyor housing 18 from intimate and meaningful contact with the receiver duct 36. After the rollered arm assemblies 140 and 140*a* are driven past the over center position by the actuating cylinders 144 and 144*a*, hydraulic flow is interrupted and pressure is locked in the cylinders, such as by a check valve (not shown) to maintain the conveyor/conveyor housing mount assemblies 84 and 84*a*, and thus the conveyor mechanism 16 and conveyor housing 18 in the transit mode position. During the transport mode, the rotary broom 20 and the drag shoes 62 and 62*a* are positioned upwardly by the action of the broom lift/lower cylinders 72 and 72*a*, and the drag shoe lift/lower cylinders 78 and 78*a*, respectively, and associated components to prevent unwanted contact with the roadway. The conveyor/conveyor housing mount assemblies 84 and 84*a* offer active support of the conveyor housing 18 during the transit mode.

Figure 11:
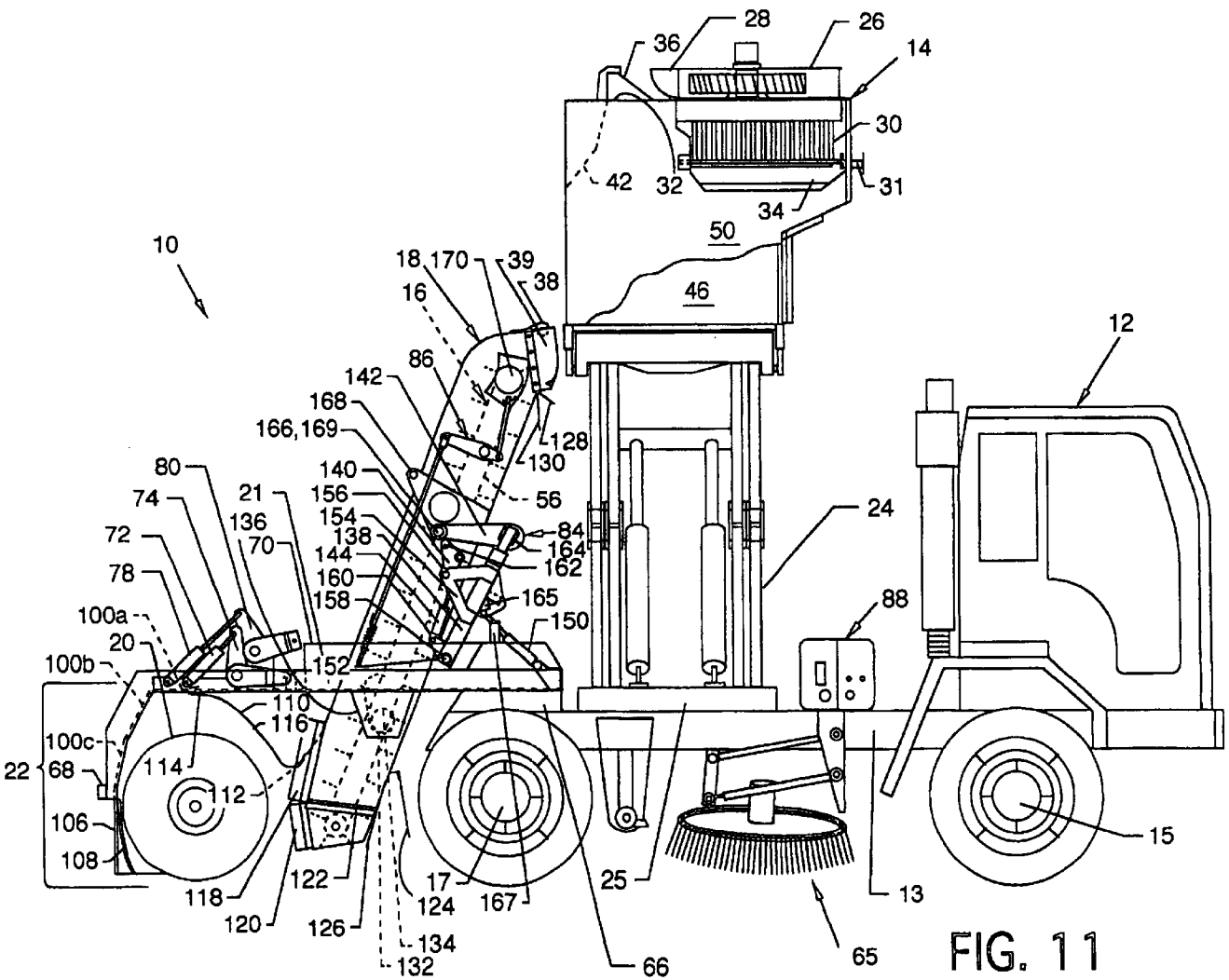

FIG. 11 illustrates the dump mode, whereby the conveyor housing 18 is raised and positioned rearwardly to accommodate removal of debris and subsequent depositing of the debris to an adjacently positioned truck from an elevated hopper 14. During the dump mode, the conveyor housing 18 is positioned upwardly in the same manner as described in FIG. 10 by powering of the actuating cylinders 144 and 144*a* to vertically position the conveyor housing 18. In addition, the conveyor housing 18 is positioned rearwardly by the action of the actuating cylinder 150. The actuating cylinder 150 urges the box tube 146 and the attached conveyor/conveyor housing mount assemblies 84 and 84*a* rearwardly to reposition, the conveyor housing 18 in a like direction. Such action causes rotation of the conveyor housing 18 about the center of the lower region of the C-channels 132 and 132*a*, which are in supportive engagement with the pucks 134 and 134*a*, to entirely remove the upper region of the conveyor housing 18 from engagement or other influence with the receiver duct 36 of the hopper 14. Such positioning allows the hopper 14 to be raised by the scissors jack assembly 24 without interference by the conveyor housing 18. The hopper 14 is then tilted or rotated by means common to the art to dump the debris into an adjacent dump truck or other suitable waste receptacle. The conveyor/conveyor housing mount assemblies 84 and 84*a* offer active support of the conveyor housing 18 during the dump mode.

Various modifications can be made to the present invention without departing from the apparent scope hereof.

PARTS LIST

| | |
|---|---|
| 10 | street sweeper |
| 12 | truck |
| 13 | chassis |
| 14 | hopper |
| 15 | forward axle |
| 16 | conveyor mechanism |
| 17 | rear axle |
| 18 | conveyor housing |
| 19 | rotary broom shroud |
| 20 | rotary broom |
| 21 | framework |
| 21a | framework |
| 22 | rotary broom chamber |
| 23 | superstructure framework |
| 23a–n | superstructure framework members |
| 24 | scissors jack assembly |
| 25 | scissors jack mounting frame |
| 26 | fan |
| 27 | shroud |
| 28 | exhaust port |
| 30 | filter |
| 31 | filter shaker mechanism |
| 32 | hopper top panel |
| 34 | plenum |
| 36 | receiver duct |
| 38 | flexible seal |
| 39 | flexible side seal |
| 39a | flexible side seal |
| 42 | angled channel |
| 44 | hopper rear panel |
| 46 | hopper dump door |
| 50 | hopper side panel |
| 52 | upper powered conveyor drive roller |
| 54 | lower powered conveyor drive roller |
| 56 | cleated belt |
| 58 | water tank |
| 59 | access hole |
| 59a | access hole |
| 60 | pivotal broom support arm |
| 60a | pivotal broom support arm |
| 61 | hydraulic drive motor assembly |
| 62 | drag shoe |
| 62a | drag shoe |
| 63 | plate |

-continued

PARTS LIST

| | |
|---|---|
| 63a | plate |
| 64 | pivotal drag shoe support arm |
| 64a | pivotal drag shoe support arm |
| 65 | gutter broom assembly |
| 65a | gutter broom assembly |
| 66 | mounting structure |
| 67 | support structure |
| 67a | support structure |
| 68 | rear bumper |
| 69 | bracket |
| 70 | framework |
| 70a | framework |
| 72 | broom lift/lower cylinder |
| 72a | broom lift/lower cylinder |
| 74 | bell crank |
| 74a | bell crank |
| 76 | cable |
| 76a | cable |
| 78 | drag shoe lift/lower cylinder |
| 78a | drag shoe lift/lower cylinder |
| 80 | bell crank |
| 80a | bell crank |
| 82 | cable |
| 82a | cable |
| 84 | conveyor/conveyor housing mount assembly |
| 84a | conveyor/conveyor housing mount assembly |
| 86 | conveyor belt tensioner assembly |
| 86a | conveyor belt tensioner assembly |
| 88 | hydraulic/fluid tank |
| 90 | fixed nonflexible panel |
| 90a | fixed nonflexible panel |
| 92 | slot |
| 92a | slot |
| 94 | flexible side panel |
| 94a | flexible side panel |
| 96 | nonflexible panel |
| 96a | nonflexible panel |
| 98 | nonflexible panel |
| 98a | nonflexible panel |
| 100a–c | fixed panels |
| 104 | fixed panel |
| 106 | flexible panel |
| 108 | flexible panel |
| 110 | large flexible seal |
| 112 | forward edge |
| 114 | rearward edge |
| 116 | outwardly facing edge |
| 116a | outwardly facing edge |
| 118 | flexible panel |
| 118a | flexible panel |
| 120 | flexible panel |
| 120a | flexible panel |
| 122 | flexible panel |
| 122a | flexible panel |
| 124 | flexible slotted panel |
| 126 | flexible slotted panel |
| 128 | flexible panel |
| 130 | flexible panel |
| 132 | C-channel |
| 132a | C-channel |
| 134 | puck |
| 134a | puck |
| 136 | bracket |
| 136a | bracket |
| 138 | pivot bar |
| 138a | pivot bar |
| 140 | rollered arm assembly |
| 140a | rollered arm assembly |
| 142 | arm |
| 142a | arm |
| 144 | actuating cylinder |
| 144a | actuating cylinder |
| 146 | box tube |
| 148 | tube |
| 150 | actuating cylinder |
| 152 | pivot pin |
| 152a | pivot pin |

-continued

| PARTS LIST | |
|---|---|
| 154 | bracket |
| 154a | bracket |
| 156 | pivot pin |
| 156a | pivot pin |
| 158 | bracket |
| 158a | bracket |
| 160 | pivot pin |
| 160a | pivot pin |
| 162 | roller |
| 162a | roller |
| 164 | bearing assembly |
| 164a | bearing assembly |
| 165 | angled support |
| 165a | angled support |
| 166 | mount fixture |
| 166a | mount fixture |
| 167 | support block |
| 167a | support block |
| 168 | lifting lug |
| 168a | lifting lug |
| 169 | pivot pin |
| 169a | pivot pin |
| 170 | hydraulic motor |
| 172 | bracket |
| 172a | bracket |
| 174 | bracket |
| 176 | bracket |
| 178 | obstacle |

What is claimed is:

1. A road speed broom sweeper with vacuumized dust control, comprising:

a. a transportable machine chassis having a front axle and at least one rear axle:

b. a vacuum source coupled to the transportable machine chassis;

c. a rotary broom controllably suspended from the transportable machine chassis rearward of the at least one war axle and controllably positioned so as to be capable of making contact with a road surface Intended to be swept;

d. a rotary broom shroud toning a rotary broom chamber in fluid communication with the vacuum source capable of being vacuumized, the rotary broom shroud being located around and about the rotary broom and having an opening adapted to be adjacent said road surface Intended to be cleaned;

e. a hopper for collecting dust, dirt, and debris:

f. a conveyor mechanism having a housing in fluid communication with the vacuum source, and the housing having a first open end In communication with the rotary broom chamber, and a second end in communication with the hopper, the conveyor mechanism adapted for transporting to the hopper any dust, dirt, and debris thrown from the rotary broom; and, g. an air filtration mechanism in the path of the air entering the hopper and exhausting out to the outside environment for substantially removing any airborne dust in air drawn from the rotary broom chamber before being exhausted to the outside environment.

2. The road speed broom sweeper of claim 1, wherein the air filtration mechanism includes a vacuum fan in communication with the outside environment for establishing an airflow from the rotary broom chamber, through the housing, entering the hopper, and exhausting from the hopper out to the outside environment thereby vacuumizing, at least in part, the rotaiy broom chamber, the housing, and the hopper.

3. A street sweeper with vacuumized dust control, comprising:

a. a rotary broom suspended frum a transportable machine chassis and controllably positioned so as to be capable of making contact with a road surface intended to be swept;

b. a rotary broom shroud forming a rotary broom chamber capable of being vacuumized, the rotary broom shroud being located around and about the rotary broom and in proximity to the road surface, at least in part;

c. a hopper capable of storing dust and debris;

d. a conveyor housing capable of being vacuumized, the conveyor housing having a first open end in communication with and coupled to the rotary broom chamber, and a second end in communication with and coupled to the hopper;

e. a conveyor mechanism in said conveyor housing for transporting dust and debris thrown from said rotary broom to the hopper;

f. a vacuum source assembly Including a vacuum fan in communication with the outside environment for establishing an airflow from the rotary broom chamber, through the conveyor housing, and entering the hopper, and exhausting from the hopper out to the outside environment, thereby vacuumizing, at least in part, said rotary broom chamber, said conveyor housing, and said hopper; and, g. a dust filter assembly in the path of the airflow entering said hopper end exhausting out to the outside environment so that any airborne duet within said hopper is substantially blocked from exhausting out to the outside environment.

4. The street sweeper of claim 3, wherein the street sweeper is capable of achieving and maintaining a predetermined travel speed while the rotary broom, fan and conveyor mechanism operate.

5. The street sweeper of claim 3, wherein the rotary broom includes pivotal broom support arms and a superstructure framework and has an elevation above the road surface and wherein the elevation may be adjusted by multiple actuating cylinders, the actuating cylinders being attached to multiple cables end the cables being located between the pivotal broom support arms and the superstructure framework.

6. The street sweeper of claim 3, wherein the chassis further includes a gutter broom assembly mounted on the underside of the chassis.

7. A street sweeper, comprising:

a. transport device;

b. a hopper carried by the transport device;

c. means for rotary sweeping, the means for rotary sweeping carried by the transport device and capable of dislodging debris and dust from a road surface;

d. means for conveying debris from the means for rotary sweeping to the hopper;

e. means for generating an airflow from the means for rotary sweeping to the hopper so as to entrain dust dislodged by the means for rotary sweeping; and, f. means for separating entrained dust from the airflow from the means for rotary sweeping at the hopper;

g. means for gutter sweeping to dislodge dust and debris from a road gutter; and, h. means for entraining dislodged dust from the means for gutter sweeping to the hopper; and i. the airflow from the means for rotary sweeping passes within a conveyor housing having a first cross sectional area and further wherein the means for separating includes increasing the cross sectional area of the airflow within the hopper relative to the airflow within the conveyor housing, thereby effecting a reduction of airflow velocity.

8. The street sweeper of claim 7, wherein the means for separating entrained dust from the airflow from the means for rotary sweeping also functions as a means for separating entrained dust from the means for gutter sweeping.

9. A method of cleaning a road surface, comprising the steps of:

a. providing a rotary broom on a truck, the truck carrying a hopper and including vacuum induced airflow from the rotary broom to the hopper and a debris conveyor from the rotary broom to the hopper;

b. rotating the rotary broom against the road surface while moving the truck in a forward direction such that the action of the rotary broom is counter to the forward direction;

c. conveying dislodged debris on the conveyor from the rotary broom to the hopper;

d. entraining airborne dust in the induced airflow from the rotary broom to the hopper, and wherein the truck further includes a gutter broom mounted forward of the rotary broom and induced airflow from the rotary broom to the hopper, and further comprising the steps of:

e. rotating the gutter broom against a gutter while moving the truck in a forward direction such that the action of the gutter broom is counter to the forward direction;

f. entraining airborne dust in the induced airflow from the gutter broom to the hopper; and, g. sweeping dislodged debris from the gutter to a position in front of the rotary brooms;

h. and separating entrained airborne dust from the induced airflow within the hopper; and i. filtering the entrained airborne dust to separate it from the induced airflow;

j. wherein the separating step includes the step of reducing velocity of the induced airflow.

10. A street sweeper with vacuumized dust control, comprising:

a. a truck, the truck having a chassis, the chassis having a front axle and at least one rear axle;

b. a superstructure framework, the superstructure framework being mounted on the chassis, the superstructure framework including a plurality of framework members and having a pair of pivotal broom support arms, the pivotal broom support arms being directed generally rearward;

c. a rotary broom, the rotary broom having opposing ends supported by the pair of pivotal broom support arms such that the rotary broom is located rearward of the at least one rear axle, the rotary broom being rotatable to sweep a road surface traveled by the truck by sweeping counter to the direction of travel;

d. a rotary broom chamber, a vacuumized chamber being located around end about the rotary broom and in close proximity to the road surface, the rotary broom chamber containing dust which becomes airborne during sweeping of the road surface by the rotary broom;

e. a hopper means attached to the chassis, the hopper being to the chassis attached via a scissors jack mounting frame and a scissors jack assembly, the hopper being capable of storing dust and debris, the hopper having a fan associated therewith, the fan causing airflow from the rotary broom chamber to the hopper and then through a filter and thereby passing out of the hopper, while airborne dust remains in the hopper, the airborne dust being substantially blocked from passing by the filter; and, f. a conveyor housing, the conveyor housing communicating between the rotary broom chamber and the hopper, the conveyor housing having a conveyor extending therethrough, the conveyor having a cleated belt which operates in a continuous loop and carries debris from the rotary broom to the hopper and simultaneously conducts the airflow and airborne dust from the rotary broom chamber through the conveyor housing to the hopper.

11. A road sweeper with dust control for cleaning a surface, the road sweeper comprising:

a. a vacuum source;

b. a main road surface cleaning head in fluid communication with the vacuum source, and having an opening adjacent a surface intended to be cleaned;

c. at least a first gutter cleaning head in fluid communication with the vacuum source, and having an opening adjacent a gutter area intended to be cleaned;

d. a hopper for collecting dust, dirt, and debris;

e. a mechanical conveying mechanism in fluid communication with the vacuum source, and thereby maintaining a flow of vacuumized air along at least a portion of the mechanism and in communication with the road surface cleaning head for transporting dust, dirt, and debris from the main road surface cleaning head to the hopper; and, f. an air filtration mechanism for substantially removing airborne dust in air drawn from the main cleaning head opening and the gutter cleaning head opening, g. the main road surface cleaning head includes an elongated rotary broom having a rotational axis substantially aligned with the surface;

h. the gutter cleaning head includes a rotary broom having an axis of rotation generally transverse to the road surface; and, i. said conveying mechanism is a conveyor mechanism for transporting the dirt and debris to the hopper, and where the conveyor mechanism is surrounded at least in part by a vacuumized housing having an open end in communication with the main road surface cleaning head, and a second open end in communication with the hopper.

12. The road sweeper of claim 11, wherein:

a. the main road surface cleaning head includes a pressurized air inlet and an air outlet whereby debris entrained with and carried along by the air being conducted through the main mad surface cleaning head exits therefrom through the conveying mechanism; and b. the conveying mechanism includes an air conduit for transporting any dirt and debris to the hopper.

13. The road sweeper of claim 11, further including an air intake plenum having, a. one or more first inlet ports in communication with an air chamber formed by the hopper;

b. at least one second inlet port in direct communication with the gutter cleaning head through an air conduit coupled thereto; and c. a plenum air exit port in communication with the vacuum source.

14. The road sweeper of claim 13, wherein:

a. the air intake filtration mechanism is mounted within, at least in part, the air plenum and includes a mechanism for loosening any dirt therewith to fall with gravity; and b. the air intake plenum includes an adjustable bottom portion open to the hopper in a first configuration, and substantially closed relative to the hopper in a second configuration, so that any loosened dirt may fall into the hopper when the adjustable bottom portion Is in the first configuration.

15. A street sweeper, comprising:

a. a plenum, the plenum being mountable on a truck-mounted dry street sweeper, the plenum having a top, at least one side and a bottom;

b. a fan mounted proximate the plenum, the fan arranged to generate an upward airflow, including airborne dust, within the plenum and toward the fan by creation of low pressure in the plenum;

c. a filter mounted proximate the fan, the filter situated to intercept airborne dust in the plenum; and, d. a hopper located proximate the plenum and separated from the plenum by at least one valve, the valve being closed, in a first configuration, and being open to allow dust to fall from the plenum to a lower hopper, in a second configuration.

e. wherein the valve is automatically closed by the occurrence of decreasing pressure in the plenum.

16. The street sweeper of claim 15, wherein the valve is automatically opened by gravity action and lack of occurrence of decressing pressure in the plenum.

17. A street sweeper, comprising:

a. a framework for mounting to a truck chassis;

b. a vacuum source carried by the framework;

c. a plenum with an adjustable bottom sealing the bottom of said plenum in a first configuration and opening the bottom of the plenum in a second configuration;

d. a hopper depending from said plenum;

e. a filter and filter shaker mechanism mounted in said plenum and an orificed plenum array with automatic flexible airflow operated valves;

f. a first elongated cleaning head in fluid communication with said vacuum, said first elongated cleaning head opening adjacent a roadway surface to be swept and about a main rotary broom for vacuumized removal of airborne dust; and, g. a connected conveyor housing providing fluid communication between said first elongated cleaning head and the vacuum source.

18. Street sweeper of claim 17, wherein the automatic flexible airflow operated flap valves of the orificed plenum array which opens at the bottom of the plenum, in the second configuration, when the vacuum source is non-operational.

19. Street sweeper of claim 17, wherein the automatic flexible airflow operated flap valves of the orificed plenum array which seals at the bottom of the plenum, in the first configuration, when the vacuum source is operational.

20. A road sweeper with dust control for cleaning a surface, the road sweeper comprising:

a. a vacuum source;

b. a main road surface cleaning head in fluid communication with the vacuum source, and having an opening adjacent a surface intended to be cleaned;

c. at least a first gutter cleaning head in fluid communication with the vacuum source, and having an opening adjacent a gutter area intended to be cleaned;

d. a hopper for collecting dust, dirt, and debris;

e. a conveying mechanism in fluid communication with the vacuum source, and thereby vacuumed, and in communication with the surface cleaning head for transporting dust, dirt, and debris from the main road surface cleaning head to the hopper; and, f. an air filtration mechanism for substantiauy removing airborne dust in air drawn from the main donning head opening and the gutter cleaning head opening, g. the main mad surface cleaning head includes an elongated rotary broom having a rotational axis substantially aligned with the surface;

h. the gutter cleaning head inciudes a rotary broom having an axis of rotation generally transverse to the road surface; and, i. said conveying mechanism is a conveyor mechanism for transporting the dirt and debris to the hopper, and where the conveyor mechanism is surrounded at least in part by a vacuumized housing having an open end in communication with the main road surface cleaning head, and a second open end in communication with the hopper.

j. wherein the main road surface cleaning head includes a pressurized air inlet and an air outlet whereby debris entrained with and carried along by the air being conducted through the main road surface cleaning head exits therefrom through the conveying mechanism;

k. the conveying mechanism is an air conduit Nor transporting any dirt end debris to the hopper;

i. an air intake plenum having one or more first inlet ports in communication with an air chamber formed by the hopper end at least one second inlet port in direct communication with the gutter cleaning head through an air conduit coupled thereto and a plenum air exit port in communication with the vacuum source;

m. the air filtration mechanism is mounted within, at least in part, the air plenum and includes a mechanism for loosening any dirt therewith to fall with gravity; and the air plenum includes an adjustable bottom portion open to the hopper in a first configuration, and substantially dosed relative to the hopper in a second configuration, so that any loosened dirt may fall into the hopper when the adjustable bottom portion is in the first configuration.

21. The road sweeper of claim 20, wherein the adjustable bottom portion includes flap valves operable in a first condition for sealing the bottom portion of the air plenum relative to the hopper, and in a second condition for opening the bottom portion open to the hopper.

22. The road sweeper of claim 21, wherein the flap valves are automatically operated by the presence or absence of airflow established by the vacuum source.

23. The road sweeper of claim 20, wherein the filtration mechanism includes:

a. a porous filter for passing air therethrough and depositing any airborne dust therewith on the filter; and b. a filter mechanism for shaking the collected dust on the porous filter to fail with gravity.

24. Street sweeper of claim 23, wherein said filter mechanism includes a cam.

25. Street sweeper of claim 24, wherein the cam lifts a rod in contact with said filter.

26. Street sweeper of claim 25, wherein the rod lifted by the cam is one of a plurality of positionable rods located at lower folds of said filter.

27. Street sweeper of claim 23, wherein said filter is held within the plenum by a plurality of fixed rods extending across atop region of the main plenum during operation of the filter mechanism.

28. The road sweeper of claim 20, wherein the filtration mechanism includes a centrifugal dust collection system for passing air therethrough and collecting any airborne dust therewith.

29. A road sweeper with dust control for cleaning a surface, the road sweeper comprising:

a. a vacuum source;

b. a main road surface cleaning head in fluid communication with the vacuum source, and having an opening adjacent a surface intended to be cleaned;

c. a hopper for collecting dust, dirt, and debris;

d. at least a portion of the conveying mechanism in fluid communication with the vacuum source, end thereby vacuumed1 and in communication with the surface cleaning head for transporting dust, dirt, and debris from the main road surface cleaning head to the hopper; and, e. an air filtration mechanism for substantially removing airborne dust in air drawn from the main cleaning head opening and the gutter cleaning head opening, the main road surface cleaning head includes an elongated rotary broom having a rotational axis substantially aligned with the surface;

f. said conveying mechanism is a conveyor mechanism for transporting the dirt and debris to the hopper, and where the conveyor mechanism is surrounded at least in part by a vacuumized housing having an open end in communication with the main road surface cleaning head, and a second open end in communication with the hopper.

30. The road sweeper of claim 29, wherein:

a. the main road surface cleaning head includes a pressurized air inlet and an air outlet whereby debris entrained with and carried along by the air being conducted through the main road surface cleaning head exits therefrom through the conveying mechanism; and b. the conveying mechanism includes an air conduit for transporting any dirt and debris to the hopper.

31. A road sweeper with dust control for cleaning a surface, the road sweeper comprising:

a. a vacuum source;

b. a main road surface cleaning head in fluid communication with the vacuum source, and having an opening adjacent a surface intended to be cleaned;

c. a hopper for collecting dust, dirt, and debris;

d. at least a portion of the conveying mechanism in fluid communication with the vacuum source and thereby vacuumed, and in communication with the surface cleaning head for transporting dust, dirt, and debris from the main road surface cleaning head to the hopper;

e. an air filtration mechanism for substantially removing airborne dust in air drawn from the main cleaning head opening;

f. the main road surface cleaning head includes an elongated rotary broom having a rotational axis substantially aligned with the surface;

g. said conveying mechanism is a conveyor mechanism for transporting the dirt and debris to the hopper and where the conveyor mechanism is surrounded at least in part by a vacuumized housing having an open end in communication with the main road surface cleaning head, and a second open end in communication with the hopper;

h. wherein the main road surface cleaning head includes a pressurized air inlet and an air ouUet whereby debris entrained with and carried along by the air being conducted through the main road surface cleaning head exits therefrom through the conveying mechanism;

i. the conveying mechanism is an air conduit for transporting any dirt and debris to the hopper;

j. an air intake plenum having one or more first inlet ports in communication with an air chamber formed by the hopper and at least one second inlet port in direct communicOtion with the gutter cleaning head through an air conduit coupled thereto and a plenum air exit port in communication with the vacuum source;

k. the air filtration mechanism is mounted within, at least in part, the air plenum and includes a mechanism for loosening any dirt therewith to fall with gravity: and the air plenum includes an adjustable bottom portion open to the hopper in a first configuration, and substantially closed relative to the hopper in a second configuration, so that any loosened dirt may fall into the hopper when the adjustable bottom portion is in the first configuration.

* * * * *